US012280922B2

(12) United States Patent
Vassallo et al.

(10) Patent No.: US 12,280,922 B2
(45) **Date of Patent: *Apr. 22, 2025**

(54) CLOSURE FOR A PACKAGE

(71) Applicant: Berry Global, Inc., Evansville, IN (US)

(72) Inventors: John A. Vassallo, Lititz, PA (US); Steven Gift, Lititz, PA (US); Frank A. Bond, York, PA (US)

(73) Assignee: Berry Global, Inc., Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/397,298

(22) Filed: Dec. 27, 2023

(65) Prior Publication Data

US 2024/0124199 A1 Apr. 18, 2024

Related U.S. Application Data

(63) Continuation of application No. 17/833,209, filed on Jun. 6, 2022, now Pat. No. 11,866,233.

(60) Provisional application No. 63/197,713, filed on Jun. 7, 2021.

(51) Int. Cl.

| | |
|---|---|
| ***B65D 47/10*** | (2006.01) |
| ***B65D 47/08*** | (2006.01) |
| ***B65D 51/22*** | (2006.01) |

(52) U.S. Cl.

CPC ..... *B65D 47/10* (2013.01); *B65D 47/08* (2013.01); *B65D 51/221* (2013.01); *B65D 2547/06* (2013.01)

(58) Field of Classification Search

CPC ..... B65D 47/10; B65D 47/08; B65D 51/221; B65D 2547/06; B65D 47/0804

See application file for complete search history.

(56) References Cited

U.S. PATENT DOCUMENTS

| | | | | |
|---|---|---|---|---|
| 4,925,051 | A * | 5/1990 | Herbst | B65D 17/401 D9/438 |
| 11,866,233 | B2 * | 1/2024 | Vassallo | B65D 51/221 |
| 2011/0056982 | A1 | 3/2011 | Swanick | |
| 2012/0080442 | A1 | 4/2012 | Groubert | |
| 2014/0217098 | A1 * | 8/2014 | Daggett | B65D 47/10 220/254.1 |
| 2015/0083724 | A1 * | 3/2015 | Lagace | B65D 5/748 220/258.4 |
| 2016/0355306 | A1 * | 12/2016 | Robin | B65D 17/4012 |
| 2019/0092535 | A1 * | 3/2019 | Circosta | B65D 41/0485 |
| 2022/0388735 | A1 | 12/2022 | Vassallo | |
| 2024/0124199 | A1 * | 4/2024 | Vassallo | B65D 47/08 |

FOREIGN PATENT DOCUMENTS

| | | |
|---|---|---|
| KR | 200445206 | 7/2009 |

* cited by examiner

*Primary Examiner* — Bob Zadeh
(74) *Attorney, Agent, or Firm* — Barnes & Thornburg LLP

(57) ABSTRACT

A package includes a container and a closure coupled to the container to control release of product therefrom. The closure includes a closure cap coupled to the container and a flip-top cap coupled to the closure cap and configured to pivot relative to the closure cap between a closed position and an opened position.

20 Claims, 8 Drawing Sheets

CLOSURE FOR A PACKAGE

PRIORITY CLAIM

This application is a Continuation of U.S. patent application Ser. No. 17/833,209, filed Jun. 6, 2022, which claims priority under 35 U.S.C. § 119(e), to U.S. Provisional Application No. 63/197,713, filed Jun. 7, 2021, each of which is expressly incorporated by reference herein.

BACKGROUND

The present disclosure relates to packages, and particularly to packages including a closure. More particularly, the present disclosure relates to a package having a closure that can change between an opened position and a closed position.

SUMMARY

According to the present disclosure, a package includes a container and a closure coupled to the container to control release of product from the container. The closure includes a closure cap coupled to the container and a flip-top cap coupled to the closure cap. The flip-top cap is configured to pivot relative to the closure cap between a closed position and an opened position.

In illustrative embodiments, the closure cap includes a side wall, a top wall coupled to an upper end of the side wall, and a breakaway flap coupled to the top wall. The closure cap is configured to change from a hermetically-sealed configuration to a product-dispensing configuration. In the hermetically-sealed configuration, the breakaway flap closes a product-dispensing aperture defined by the top wall of the closure cap. In the product-dispensing configuration, the breakaway flap at least partially separates from the top wall to allow release of product from the container through the product-dispensing aperture.

In illustrative embodiments, the breakaway flap includes a flap base fixed to the top wall of the closure cap, a frangible border extending at least partway around the product-dispensing aperture between the top wall and the flap base, a push pad coupled to a generally central region of the flap base, and a hinge coupled between the flap base and the top wall. The hinge provides a horizontal pivot axis between the flap base and the top wall. The frangible border of the breakaway flap and the hinge provide an outer perimeter of the breakaway flap. The outer perimeter may be entirely, integrally coupled to the top wall to provide the hermetically sealed configuration before the breakaway flap is opened. The frangible border is configured to at least partially separate from the top wall as the closure changes from the hermetically-sealed configuration to the product-dispensing configuration. The hinge allows the flap base and the push pad to pivot about the horizontal pivot axis after application of a downward force on the push pad by the user to break the frangible border.

In illustrative embodiments, the closure further includes a flap retainer. The flap retainer is configured to engage and retain the breakaway flap in the product-dispensing configuration. The flap retainer includes an interruption coupled to an inner surface of the closure facing toward a central axis of the closure. In some embodiments, the interruption may be a notch defined partially by a lip that is arranged to lie at an angle relative to the central axis. In other embodiments, the interruption may be a protrusion that extends toward the central axis.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 4:
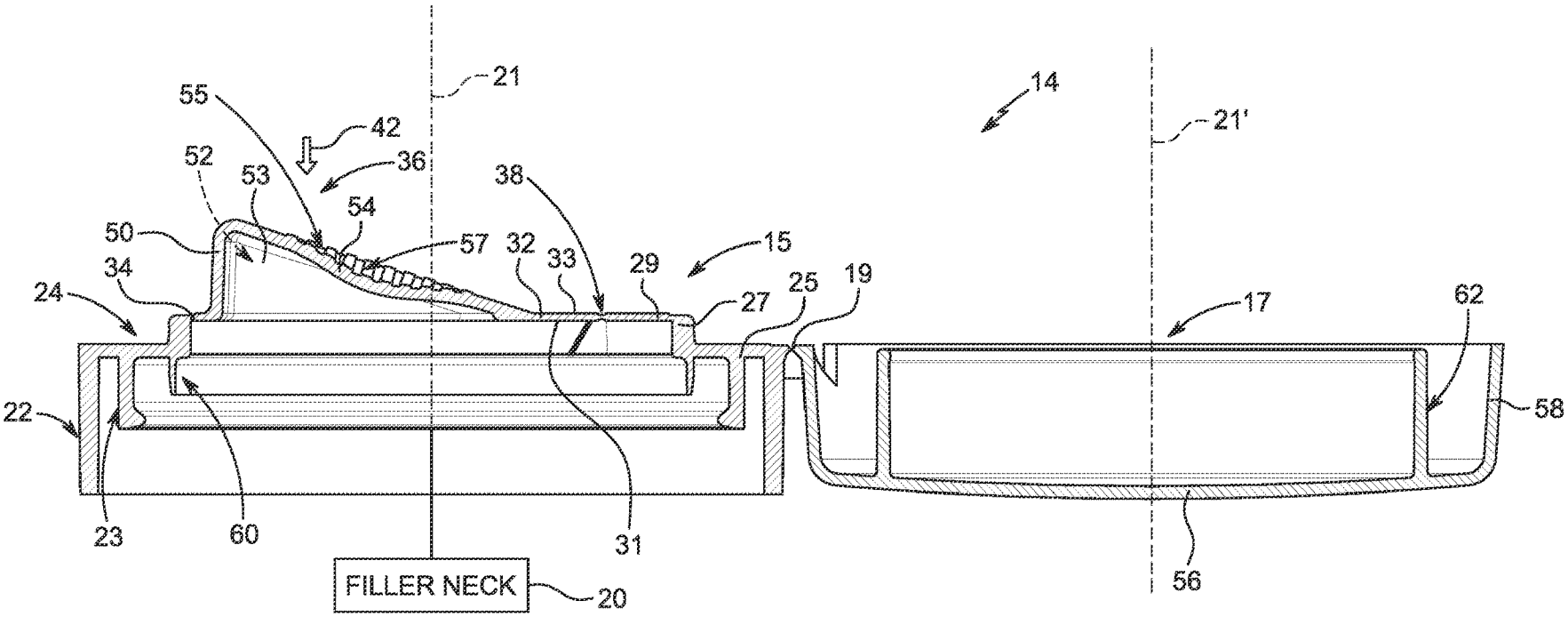
FIG. 4 is a sectional view taken along line 4-4 in FIG. 1 showing that the breakaway flap includes a flap base fixed to the top wall, a push pad coupled to a generally central region of the flap base, and a hinge coupled between the flap base and the top wall.
Figure 5:
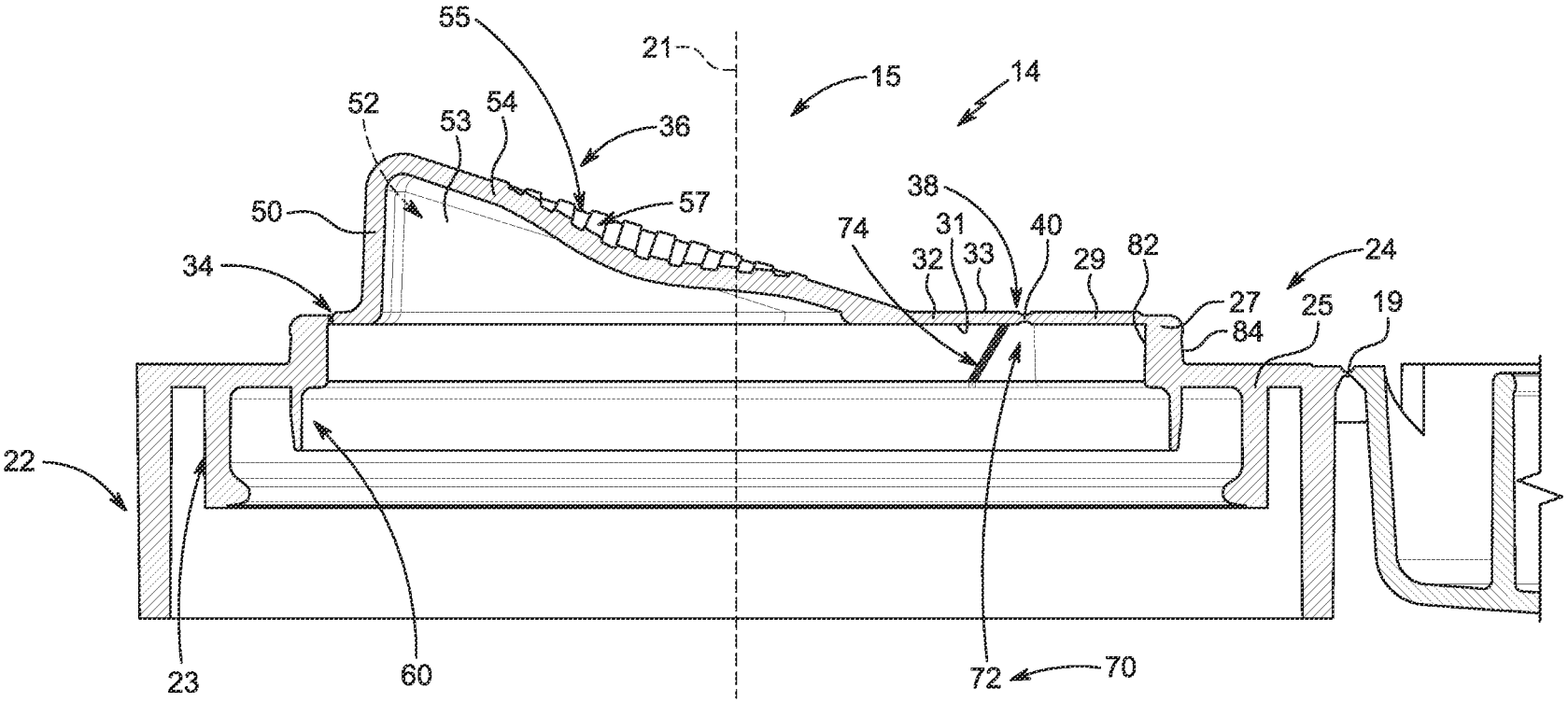
Figure 6:
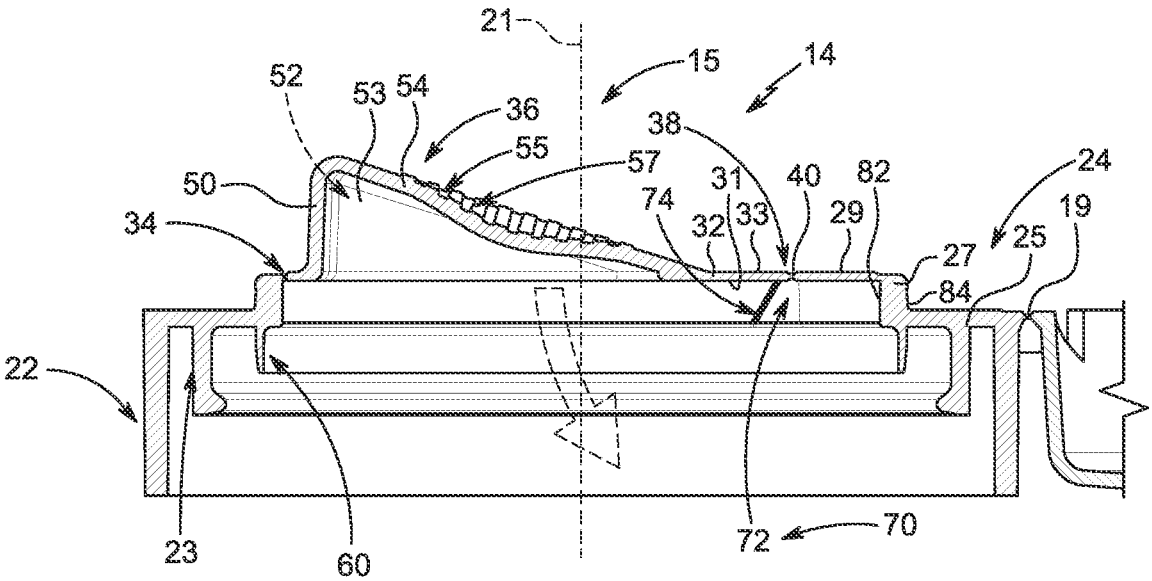
Figure 7:
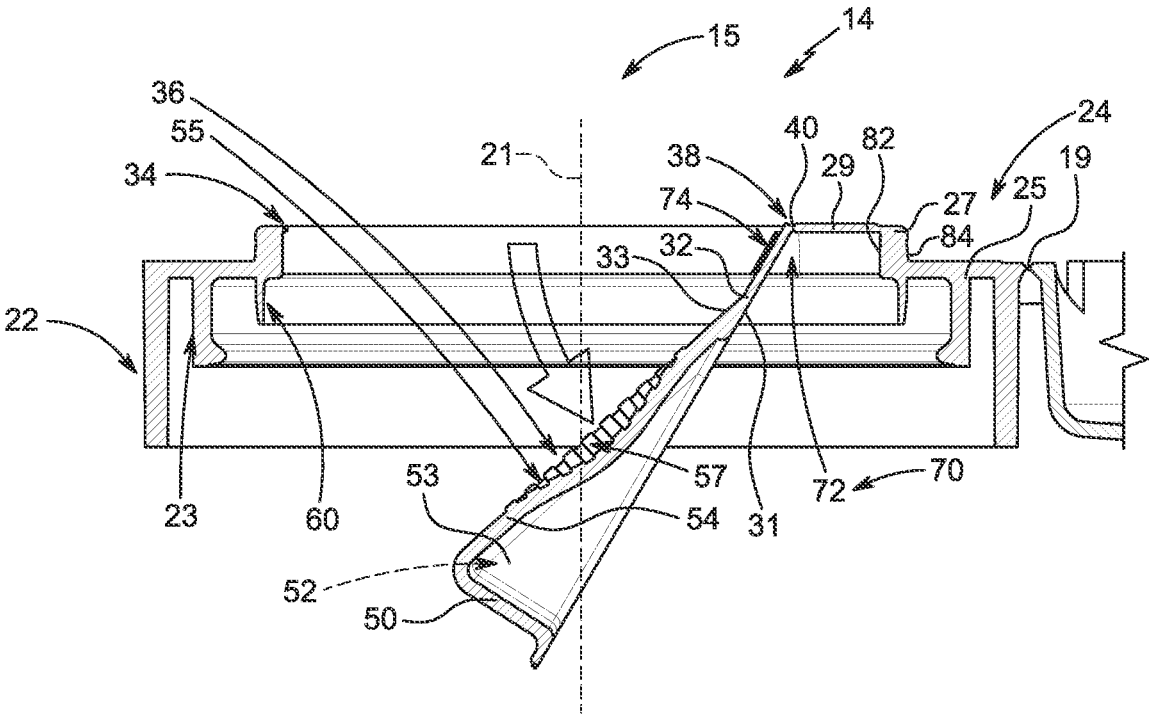
Figure 8:
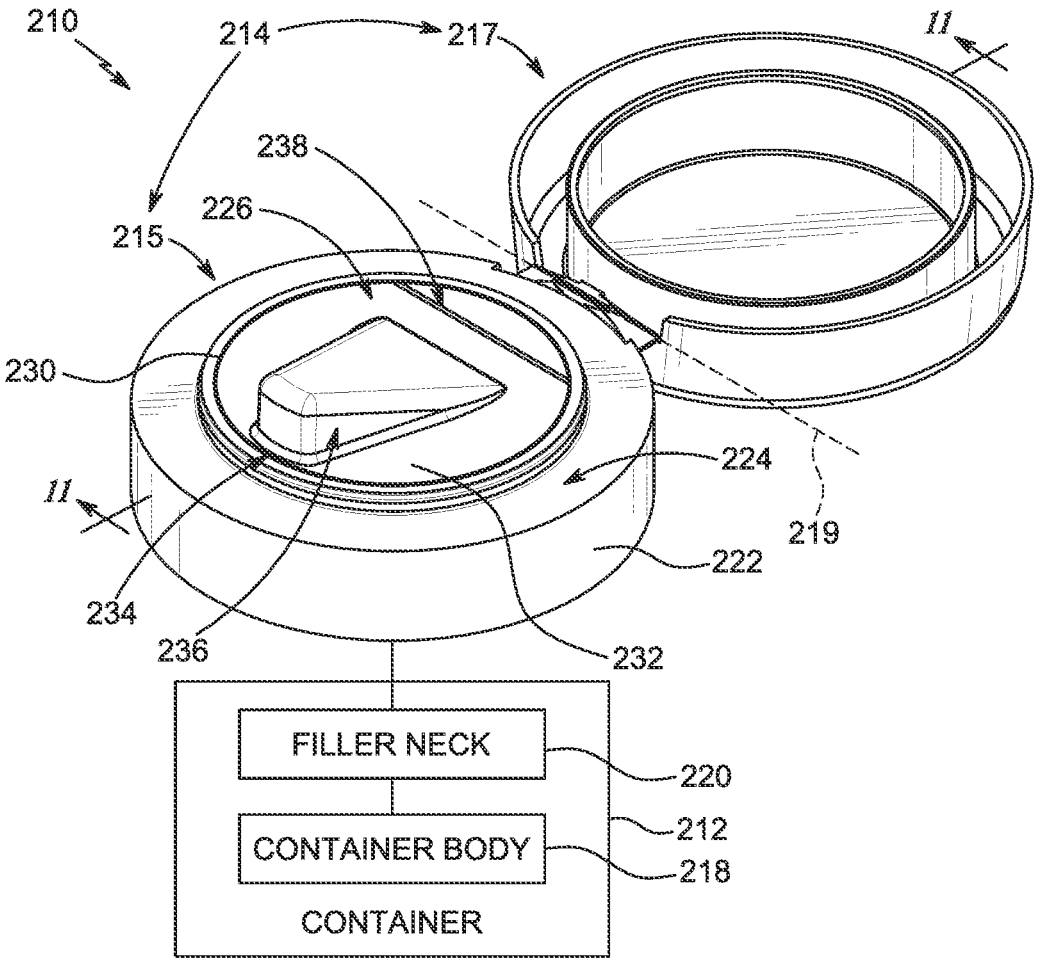
Figure 9:
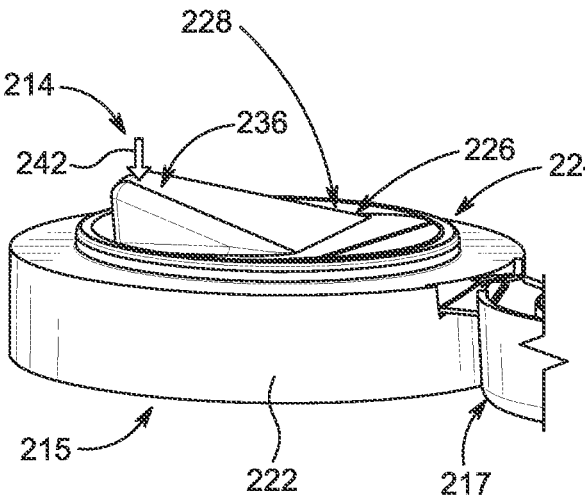
Figure 10:
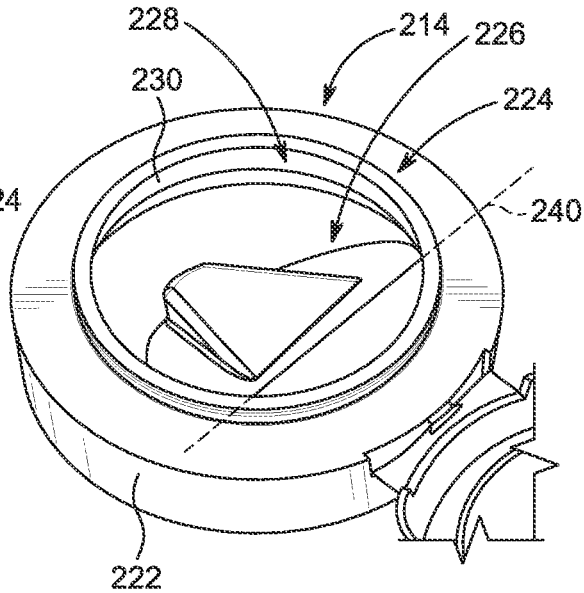
Figure 11:
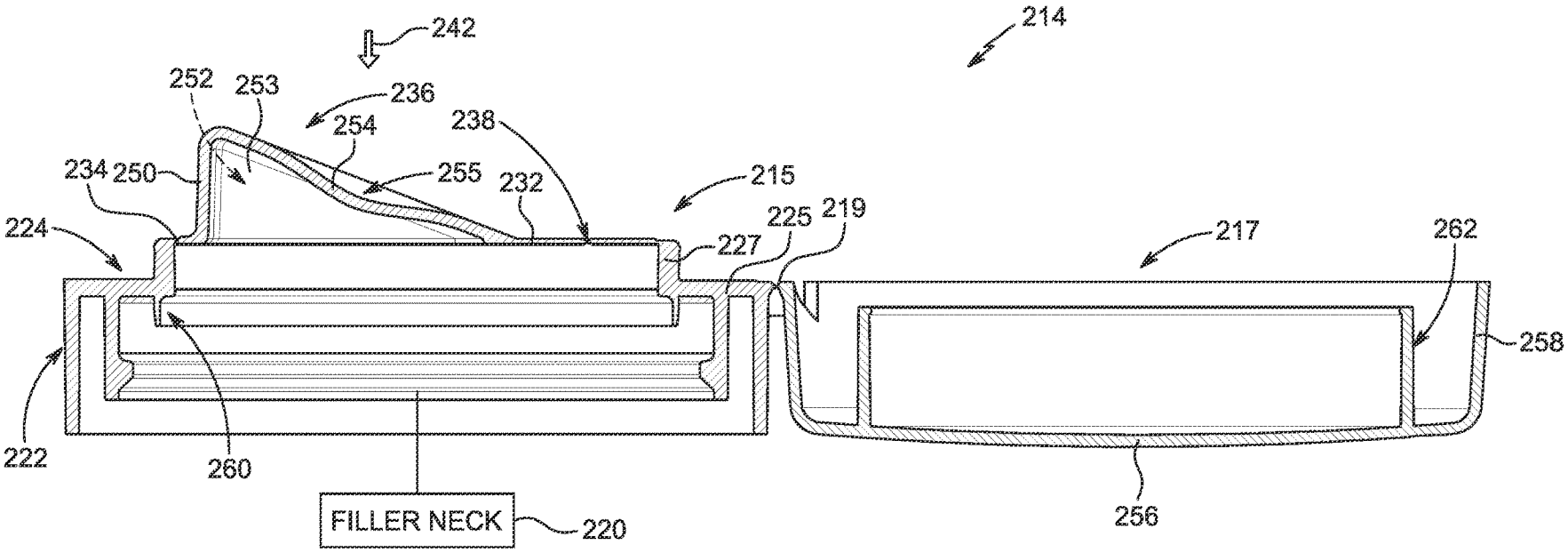
Figure 12:
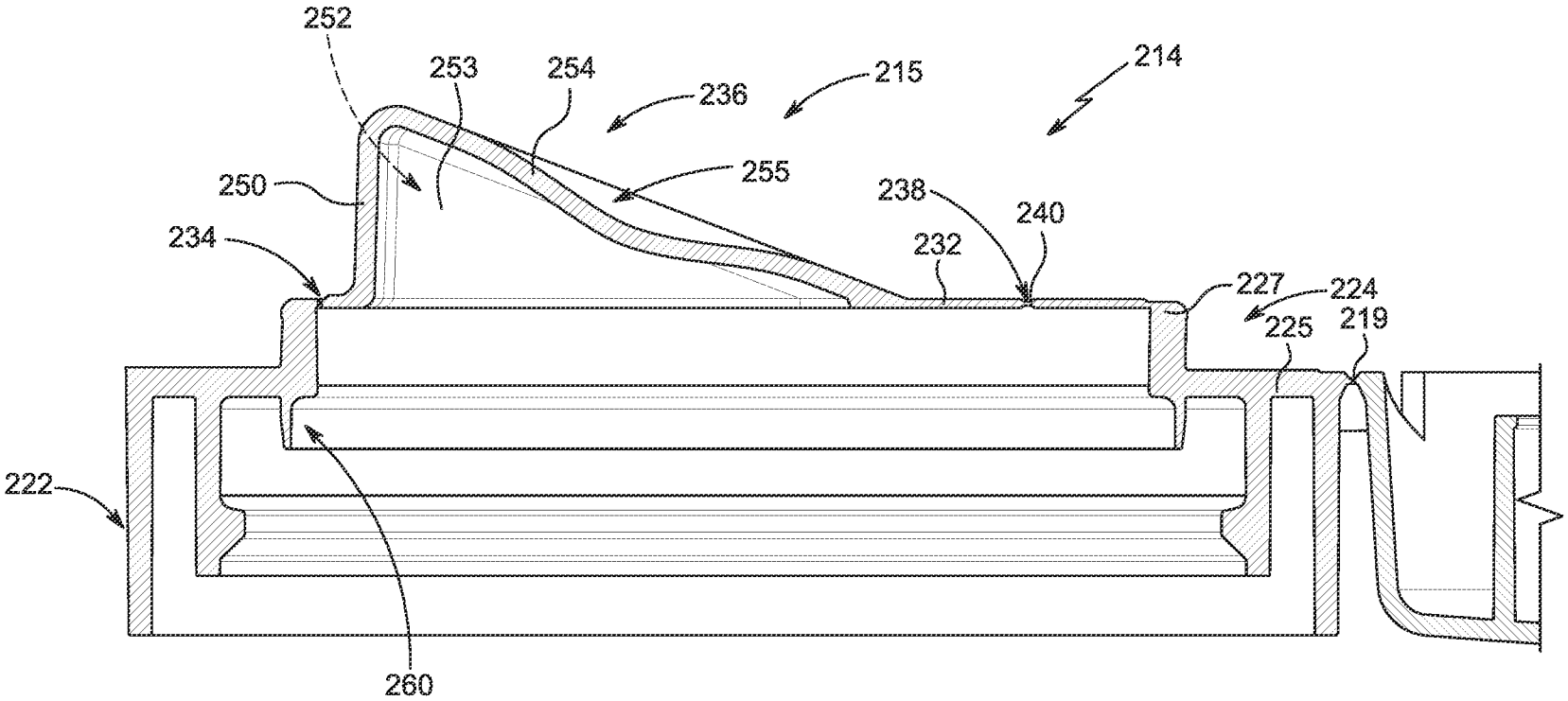

FIG. 5 is an enlarged area of the sectional view of FIG. 4 showing that the push pad includes a top wall having a depression for an ergonomic fit with a user's thumb; and FIG. 6 is an enlarged area of the sectional view of FIG. 4 showing that the closure includes a flap retainer that provides an interruption on an inner surface of the side wall to retain the breakaway flap in the product-dispensing configuration;

FIG. 7 is an enlarged area of the sectional view of FIG. 4 showing the breakaway flap moved toward the product-dispensing configuration and the interruption engaging and retaining the breakaway flap in the product-dispensing configuration;

FIG. 8 is a perspective and diagrammatic view of another embodiment of a package in accordance with the present disclosure including a container and a closure coupled to the container to control release of products therefrom;

FIG. 9 is a perspective view of the closure showing that the closure includes a side wall, a top wall coupled to an upper end of the side wall, and a breakaway flap coupled to the top wall, the breakaway flap configured to separate partially from the top wall upon application of a downward force on the breakaway flap to open a product-dispensing aperture;

FIG. 10 is a perspective view of the closure of FIGS. 8 and 9 showing the breakaway flap moved toward a product-dispensing position;

FIG. 11 is a sectional view taken along line 11-11 in FIG. 8;

FIG. 12 is an enlarged area of the sectional view of FIG. 11; and

Figure 13:
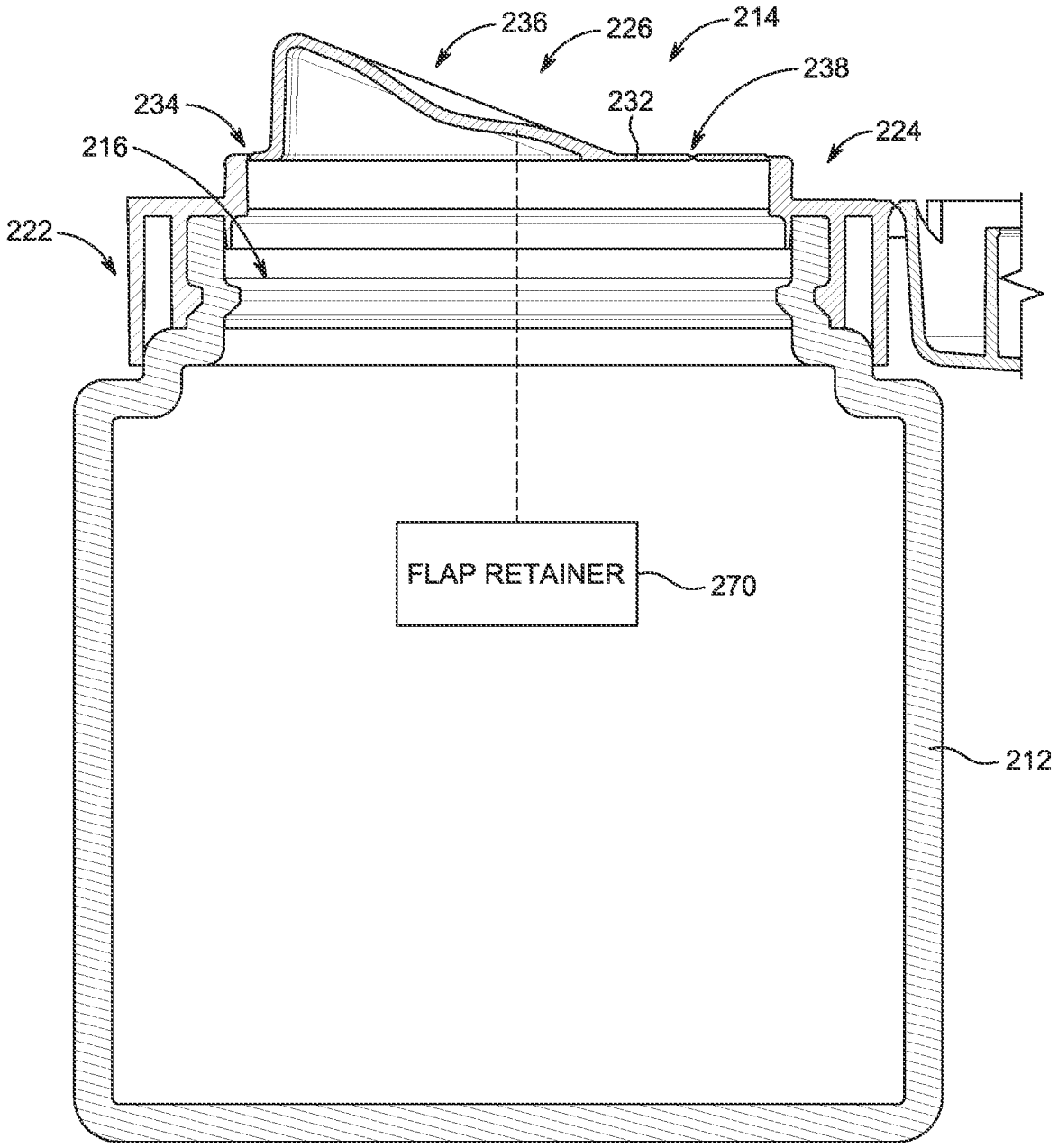

FIG. 13 is a sectional and diagrammatic view of the package showing that the package may further include a flap retainer to hold the breakaway flap in a fully opened position.

DETAILED DESCRIPTION

Figure 1:
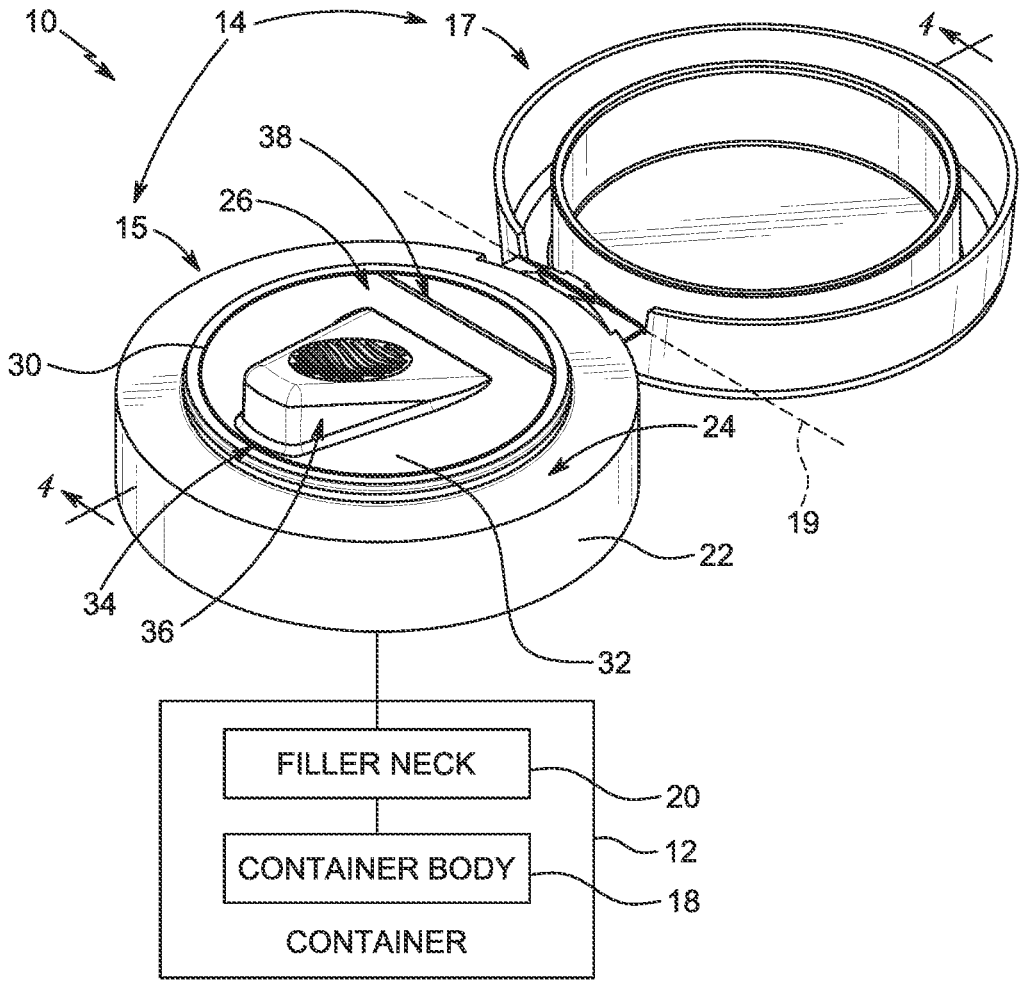
FIG. 1 is a perspective and diagrammatic view of a package in accordance with the present disclosure, showing that the package includes a container and a closure coupled to the container to control release of product therefrom.

A package 10 in accordance with the present disclosure includes a container 12 and a closure 14 configured to be mounted on the container 12 as shown in FIG. 1. The container 12 includes a container body 18 and a filler neck 20 formed to include a mouth (not shown). The mouth opens into an interior product-storage region (not shown) defined by the container body 18 and the filler neck 20. The closure 14 is configured to mount to the filler neck 20 of the container 12 to close selectively the mouth defined by the filler neck 20 opening into the interior product-storage region. The closure 14 controls release of product from the container 12.

The closure 14 may be opened and closed by a user to change the package 10 from a closed position to an opened position. The closure 14 includes a closure cap 15 and a flip-top cap 17 coupled to the closure cap 15. The closure cap 15 is configured to engage with the filler neck 20 to retain the closure 14 to the container 12. The flip-top cap 17 is mounted to the closure cap 15 for pivotable movement about a closure pivot axis 19 between the closed position blocking release of products through the mouth from the interior product-storage region and the opened position allowing release of product through the mouth from the interior product-storage region.

Figure 2:
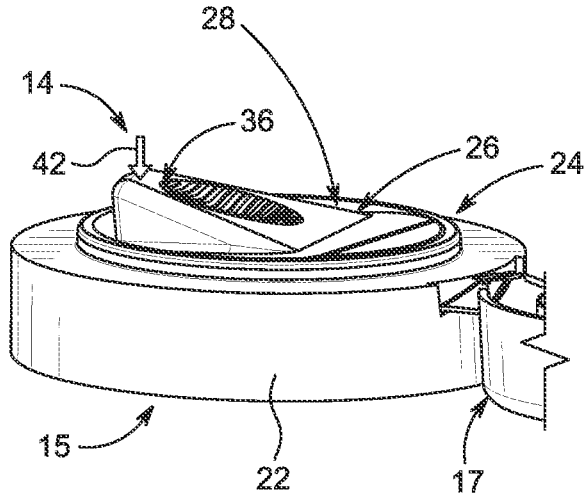
FIG. 2 is a perspective view of the closure showing that the closure includes a side wall, a top wall coupled to an upper end of the side wall, and a breakaway flap coupled to the top wall, and also showing that the breakaway flap is configured to separate partially from the top wall upon application of a downward force on the breakaway flap to open a product-dispensing aperture.
Figure 3:
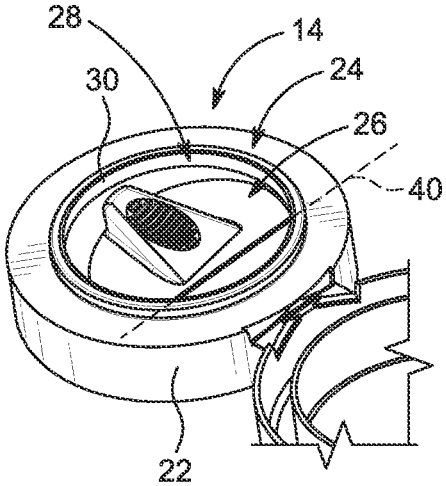
FIG. 3 is a perspective view of the closure of FIGS. 1 and 2 showing the breakaway flap moved toward a product-dispensing configuration to allow release of product from the container through the product-dispensing aperture.

The closure cap 15 of closure 14 is configured to change from an unopened, hermetically-sealed configuration, as shown in FIG. 1, to a product-dispensing configuration as shown in FIGS. 2 and 3. The closure cap 15 includes a first side wall 22, a second side wall 23 spaced radially inwardly from the first side wall 22 relative to a central axis 21 of the closure cap 15, a top wall 24 coupled to an upper end of both the first side wall 22 and the second side wall 23, and a breakaway flap 26 coupled to the top wall 24. The second side wall 23 is adapted to engage with the filler neck 20 to retain the closure 14 on container 12. The top wall 24 partially covers the mouth of the container 12 and defines a product-dispensing aperture 28 that is configured to release product from the interior product-storage region when the package 10 is tilted to a product dispensing orientation. The breakaway flap 26 has an outer perimeter 30 that is entirely, integrally coupled to the top wall 24 to provide the unopened, hermetically-sealed configuration. At least a portion of the breakaway flap 26 may be separated from the top wall 24 at the perimeter 30 to change the closure 14 from the hermetically-sealed configuration to the product-dispensing configuration.

The breakaway flap 26 includes a flap base 32, a frangible border 34, a push pad 36, and a hinge 38 as shown in FIGS. 1-5. The flap base 32 is fixed to the top wall 24 and cooperates with the push pad 36 to cover the product dispensing aperture 28 in the hermetically-sealed configuration. The frangible border 34 provides at least a portion of the perimeter 30 of the breakaway flap 26 and is configured to at least partially separate from the top wall 24 as the closure 14 changes from the hermetically-sealed configuration to the product-dispensing configuration. The frangible border 34 extends at least partway around the product-dispensing aperture 28 between the top wall 24 and the flap base 32. The push pad 36 is coupled to the flap base 32 and is configured to be engaged by a user to change the closure from the hermetically-sealed configuration to the product-dispensing configuration. The hinge 38 allows the flap base 32 to pivot about a hinge axis 40 provided by the hinge 38 after application of a downward force 42 on the push pad 36 by the user to break the frangible border 34 so that the closure 14 changes from the hermetically-sealed configuration to the product-dispensing configuration. The breakaway flap 26 provides tamper evidence to the user. In the product-dispensing configuration, release of product from the container 12 is allowed through the product-dispensing aperture 28.

The push pad 36 is arranged to lie in a generally central region of the flap base 32 as shown in FIGS. 1 and 4. The push pad 36 includes a front wall 50, a pair of side walls 52, 53, and a top wall 54 as shown in FIGS. 4 and 5. The front wall 50 is arranged adjacent to and radially inward of the frangible border 34 relative to the central axis 21. The top wall 54 is inclined axially and radially away from hinge 38 so the downward force 42 on the top wall 54 transfers the force to the front wall 50 near the frangible border 34 to cause the frangible border 34 to break and separate the breakaway flap 26 from the top wall 24 of the closure cap 15. The top wall 54 illustratively extends inward toward filler neck 20 to form a depression 55 for an ergonomic fit with a user's thumb for example. The depression 55 illustratively includes a plurality of ribs 57 that extend horizontally along the depression 55 relative to the hinge axis 40 to provide additional grip for the user's thumb for example. In some embodiments, the depression 55 may not include the plurality of ribs 57.

The closure 14 may be formed from polymeric materials using a process such as thermoforming, blow molding, injection molding, etc., or any other suitable process. The closure cap 15 of closure 14 may be initially formed without the frangible border 34 and the hinge 38 following the process. The frangible border 34 and the hinge 38 may be formed in the closure cap 15 by machining or scoring. In some embodiments, the frangible border 34 and the hinge 38 are formed during the process.

The frangible border 34 has a smaller thickness compared to a thickness of the hinge 38 so that the breakaway flap 26 separates from the top wall 24 only along frangible border 34. For example, the thickness of both the frangible border 34 and the hinge are each defined axially relative to the central axis 21 between an upper surface 31 of the flap base 32 and a lower surface 33 of the flap base 32. The breakaway flap 26 remains tethered or attached to the top wall 24 by hinge 38 so that the breakaway flap 26 is not lost during a recycling or material reclaiming process, for example.

The closure cap 15 may further include an annular plug seal 60 formed on an inside surface of the top wall 24. The annular plug seal 60 is adapted to engage the filler neck 20 of the container 12 to seal between the closure cap 15 and the container 12. The annular plug seal 60 is positioned radially inward from the second side wall 23 relative to the central axis 21.

The top wall 24 of the closure cap 15 includes a first horizontal portion 25, a vertical portion 27, and a second horizontal portion 29 as shown in FIGS. 4 and 5. The horizontal portion 25 is arranged radially outward from the vertical portion 27 relative to the central axis 21 and is coupled to both the first side wall 22 and the second side wall 23 of the closure cap 15. The vertical portion 27 extends axially upward from a radially inner edge of the first horizontal portion 25 relative to the central axis 21. The second horizontal portion 29 is coupled to an upper end of the vertical portion 27 and supports the breakaway flap 26 at the hinge 38. The vertical portion 27 extends axially outward above the annular plug seal 60 and is spaced radially outward from the breakaway flap 26 relative to the central axis 21. The second horizontal portion 29 is axially spaced from the first horizontal portion 25.

The container 12 or the closure 14 may further include a flap retainer 70 as shown in FIGS. 6 and 7. In the illustrative example the flap retainer 70 is coupled to the top wall 24. In one example, the flap retainer 70 is coupled to the filler neck 20 or the container body 18. In another example, the flap retainer 70 is coupled to the first side wall 22, the second side wall 23 of the closure cap 15 or any other suitable portion of the closure 14. The flap retainer 70 is configured to retain the breakaway flap 26 in a fully opened position inside the product-storage region so that the breakaway flap 26 does not impede release of product from the product-storage region. In some embodiments, the breakaway flap 26 may pivot away from the container 12 when changing from the interior product-storage region.

In the illustrative embodiment, the flap retainer 70 is an interruption 72, as shown in FIGS. 6-7. The interruption 72 is coupled to an inner surface 82 of the vertical portion 27 of the top wall 24, the inner surface 82 facing radially inward toward the central axis 21. The interruption 72 in the illustrative embodiment is a notch 72 that extends radially outward from the inner surface 82 of the vertical portion 27 towards an outer surface 84 of the vertical portion 27. The notch 72 is partially defined by a lip 74 that lies at an angle relative to the central axis 21. The lip 74 includes a first end and a second end. The first end is spaced apart from an end of the hinge 38 by a first circumferential distance that is greater than or equal to a thickness of the breakaway flap 26. The thickness of the breakaway flap 26 is defined axially between an upper surface 31 of the flap base 32 and a lower surface 33 of the flap base 32. The second end is spaced apart from the end of the hinge 38 by a second circumferential distance that is greater than the first circumferential distance so that the second end is radially inward of the first end relative to the central axis 21.

In some embodiments, the interruption 72 is a first interruption 72, and the flap retainer 70 further includes a second interruption (not shown) spaced circumferentially apart from the first interruption 72 relative to the central axis 21. For example, the first end of the first interruption or notch 72 is spaced apart from a first end of the hinge 38 by the first circumferential distance, and the first end of the second interruption or notch is spaced apart from a second end of the hinge 38 by the same first circumferential distance. In some embodiments, the interruption 72 may be a projection such as a bump, a rib, or a ridge.

The closure cap 15 further includes an annular plug seal 60 formed on an inside surface of the top wall 24. The annular plug seal 60 is adapted to engage the filler neck 20 of the container 12 to seal between the closure cap 15 and the container 12. The annular plug seal 60 is positioned radially inward of the second side wall 23 relative to the central axis 21.

The flip-top cap 17 includes a top wall 56, a side wall 58 arranged to extend downwardly from the top wall toward closure cap 15 when the closure 14 is in the closed position, and an annular plug seal 62 coupled to an inside surface of the top wall 56 as shown in FIG. 4. The annular plug seal 62 is spaced radially inward from side wall 58 relative to a central axis 21'. The annular plug seal 62 has an inner diameter that corresponds with an outer diameter of the vertical portion 27 of the top wall 24 of closure cap 15. In the closed position, the annular plug seal 62 of flip-top cap 17 engages the vertical portion 27 of the top wall 24 to seal between the closure cap 15 and the flip-top cap 17.

A package 210 in accordance with another embodiment of the present disclosure includes a container 212 and a closure 214 configured to be mounted on the container 212 as shown in FIG. 8. The container 212 includes a container body 218 and a filler neck 220 formed to include a mouth 216, as shown in FIG. 13. The mouth 216 opens into an interior product-storage region (not shown) defined by the container body 218 and the filler neck 220. The closure 214 is configured to mount to the filler neck 220 of the container 212 to close selectively the mouth 216 defined by the filler neck 220 opening into the interior product-storage region.

The closure 214 may be opened and closed by a user to change the package 210 from a closed position to an opened position. The closure 214 includes a closure cap 215 and a flip-top cap 217 coupled to the closure cap 215. The closure cap 215 is configured to engage with the filler neck 220 to retain the closure 214 to the container 212. The flip-top cap 217 is mounted to the closure cap 215 for pivotable movement about a closure pivot axis 219 between the closed position blocking release of products through the mouth 216 from the interior product-storage region and the opened position allowing release of product through the mouth 216 from the interior product-storage region.

The closure cap 215 of closure 214 is configured to change from an unopened, hermetically-sealed configuration, as shown in FIG. 8, to a product-dispensing configuration as shown in FIGS. 9 and 10. The closure cap 215 includes a side wall 222, a top wall 224 coupled to an upper end of the side wall 222, and a breakaway flap 226 coupled to the top wall 224. The side wall 222 is adapted to engage with the filler neck 220 to retain the closure 214 on container 212. The top wall 224 partially covers the mouth 216 of the container 212 and defines a product-dispensing aperture 228 that is configured to release product from the interior product-storage region when the package 210 is tilted to a product dispensing orientation. The breakaway flap 226 has an outer perimeter 230 that is entirely, integrally coupled to the top wall 224 to provide the unopened, hermetically-sealed configuration. At least a portion of the breakaway flap 226 may be separated from the top wall 224 at the perimeter 230 to change the closure 214 from the hermetically-sealed configuration to the product-dispensing configuration.

The breakaway flap 226 includes a flap base 232, a frangible border 234, a push pad 236, and a hinge 238 as shown in FIGS. 8-12. The flap base 232 cooperates with the push pad 236 to cover the product dispensing aperture 228 in the hermetically-sealed configuration. The frangible border 234 provides the perimeter 230 of the breakaway flap 226 and is configured to at least partially separate from the top wall 224 as the closure 214 changes from the hermetically-sealed configuration to the product-dispensing configuration. The push pad 236 is coupled to the flap base 232 and is configured to be engaged by a user to change the closure from the hermetically-sealed configuration to the product-dispensing configuration. The hinge 238 allows the breakaway flap 226 to pivot about a hinge axis 240 after application of a downward force 242 on the push pad 236 by the user to break the frangible border 234 so that the closure 214 changes from the hermetically-sealed configuration to the product-dispensing configuration. The breakaway flap 226 provides tamper evidence to the user.

The push pad 236 is arranged to lie in a generally central region of the flap base 232 as shown in FIGS. 8 and 11. The push pad 236 includes a front wall 250, a pair of side walls 252, 253, and a top wall 254 as shown in FIGS. 11 and 12. The front wall 250 is arranged adjacent to the frangible border 234. The top wall 254 is inclined away from hinge 238 so downward force 242 on the top wall 254 transfers the force to the front wall 250 near frangible board 234 to cause frangible border to break and separate the breakaway flap 226 from top wall 224 of closure cap 215. The top wall 254 illustratively extends inwardly toward filler neck 220 to form a depression 255 for an ergonomic fit with a user's thumb for example.

The closure 214 may be formed from polymeric materials using a process such as thermoforming, blow molding, injection molding, etc., or any other suitable process. The closure cap 215 of closure 214 may be initially formed without the frangible border 234 and the hinge 238 following the process. The frangible border 234 and the hinge 238 may be formed in the closure cap 215 by machining or scoring. In some embodiments, the frangible border 234 and the hinge 238 are formed during the process.

The frangible border 234 has a smaller thickness compared to a thickness of the hinge 238 so that the breakaway flap 226 separates from the top wall 224 only along frangible border 234. The breakaway flap 226 remains tethered to the top wall 224 by hinge 238 so that the breakaway flap 226 is not lost during a recycling or material reclaiming process, for example.

The container 212 or the closure 214 may further include a flap retainer 270. In one example, the flap retainer 270 is coupled to the filler neck 220 or the container body 218. In another example, the flap retainer 270 is coupled to the side wall 222 of the closure cap 215 or any other suitable portion of the closure 214. The flap retainer 270 is configured to retain the breakaway flap 226 in a fully opened position inside the product-storage region so that the breakaway flap 226 does not impede release of product from the product-storage region. In some embodiments, the breakaway flap 226 may pivot away from the container 212 when changing from the interior product-storage region.

The closure cap 215 further includes an annular plug seal 260 formed on an inside surface of the top wall 224. The annular plug seal 260 is adapted to engage the filler neck 220 of the container 212 to seal between the closure cap 215 and the container 212.

The top wall 224 of the closure cap 215 includes a horizontal portion 225 and a vertical portion 227 as shown in FIGS. 11 and 12. The horizontal portion 225 is arranged radially outward from the vertical portion 227 and is coupled to the side wall 222 of the closure cap 215. The vertical portion 227 extends upwardly from an inner edge of the horizontal portion 225. An upper end of the vertical portion 227 supports the breakaway flap 226 above the horizontal portion 225.

The flip-top cap 217 includes a top wall 256, a side wall 258 arranged to extend downwardly from the top wall toward closure cap 215, and an annular plug seal 262 coupled to an inside surface of the top wall 256 as shown in FIG. 11. The annular plug seal 262 is spaced inwardly from side wall 258. The annular plug seal 262 has an inner diameter that corresponds with an outer diameter of the vertical portion 227 of the top wall 224 of closure cap 215. In the closed position, the annular plug seal 262 of flip-top cap 217 engages the vertical portion 227 of the top wall 224 to seal between the closure cap 215 and the flip-top cap 217.

The invention claimed is:

1. A package comprising a container and a closure coupled to the container to control release of product therefrom, wherein the closure includes a side wall, a top wall coupled to an upper end of the side wall, and a breakaway flap coupled to the top wall, wherein the closure is configured to change from a closed configuration in which the breakaway flap closes a product-dispensing aperture defined by the top wall, to a product-dispensing configuration, in which the breakaway flap at least partially separates from the top wall to allow release of the product from the container through the product-dispensing aperture, wherein the breakaway flap includes a flap base coupled to the top wall, a frangible border that extends at least partway around the product-dispensing aperture between the top wall and the flap base, a push pad coupled to a central region of the flap base, and a hinge coupled between the flap base and the top wall to provide a pivot axis therebetween, and wherein the push pad includes a plurality of side walls and a top wall, and the top wall of the push pad is inclined to extend away from the hinge.

2. The package of claim 1, wherein the frangible border of the breakaway flap and the hinge provide an outer perimeter of the breakaway flap that is entirely, integrally coupled to the top wall to provide a hermetically-sealed configuration when the closure is in the closed configuration, and wherein the frangible border is configured to at least partially separate from the top wall as the closure changes from the hermetically-sealed configuration to the product-dispensing configuration and the hinge allows the flap base and the push pad to pivot about the pivot axis after application of a downward force on the push pad by the user to break the frangible border.

3. The package of claim 1, wherein the top wall of the push pad is formed to include a depression.

4. The package of claim 1, wherein the frangible border has a smaller thickness compared to a thickness of the hinge so that the breakaway flap separates from the top wall only along the frangible border and remains attached to the top wall along the hinge.

5. The package of claim 1, wherein the closure further includes a flap retainer that is configured to engage and retain the breakaway flap in the product-dispensing configuration.

6. The package of claim 5, wherein the flap retainer includes an interruption formed on an interior surface of the closure.

7. The closure of claim 6, wherein the interruption is defined at least partially by a lip that is arranged to lie at an angle relative to a central axis of the closure.

8. A closure comprising a side wall, a top wall coupled to an upper end of the side wall, and a breakaway flap coupled to the top wall, wherein the closure is configured to change from a closed configuration in which the breakaway flap closes a product-dispensing aperture defined by the top wall, to a product-dispensing configuration, in which the breakaway flap at least partially separates from the top wall to allow release of product through the product-dispensing aperture, wherein the breakaway flap includes a flap base coupled to the top wall, a frangible border that extends at least partway around the product-dispensing aperture between the top wall and the flap base, a push pad coupled to a central region of the flap base, and a hinge coupled between the flap base and the top wall to provide a pivot axis therebetween, and wherein the push pad includes a plurality of side walls and a top wall, and the top wall of the push pad is inclined to extend away from the hinge.

9. The closure of claim 8, further comprising a flap retainer that is configured to engage and retain the breakaway flap in the product-dispensing configuration, and wherein the flap retainer includes an interruption formed on an inner surface of the closure.

10. The closure of claim 9, wherein the interruption is a first interruption and the flap retainer further includes a second interruption coupled to the inner surface of the closure and that is spaced circumferentially apart from the first interruption around a central axis of the closure.

11. The closure of claim 9, wherein the interruption is a notch defined partially by a lip that is arranged to lie at an angle relative to a central axis of the closure, the lip includes a first end spaced apart from an end of the hinge by a first circumferential distance that is greater than or equal to a thickness of the breakaway flap, and the lip includes a second end that is spaced apart from the end of the hinge by a second circumferential distance that is greater than the first circumferential distance.

12. A closure configured to control release of product from a container, the closure comprising a side wall, a top wall coupled to an upper end of the side wall, and a breakaway flap coupled to the top wall, wherein the closure is configured to change from a closed configuration in which the breakaway flap closes a product-dispensing aperture defined by the top wall, to a product-dispensing configuration, in which the breakaway flap at least partially separates from the top wall to allow release of the product from the container through the product-dispensing aperture, wherein the closure further includes a flap retainer that is configured to engage and retain the breakaway flap in the product-dispensing configuration, and wherein the flap retainer includes an interruption formed on an inner surface of the closure.

13. The closure of claim 12, wherein the top wall of the closure includes a horizontal portion and a vertical portion coupled to a radially inner edge of the horizontal portion and the breakaway flap is spaced radially inward from the vertical portion, and wherein the closure further includes a flip-top cap having a top wall and an annular plug seal arranged to extend downwardly from the top wall, the annular plug seal having an inner surface with a diameter that is equal to a diameter of the vertical portion of the top wall of the closure such that the vertical portion and the annular plug seal form a sealing interface with one another when the flip-top cap is in a closed position.

14. The closure of claim 12, wherein the breakaway flap includes a flap base fixed to the top wall, a frangible border that extends at least partway around the product-dispensing aperture between the top wall and the flap base, a push pad coupled to a central region of the flap base, and a hinge coupled between the flap base and the top wall to provide a horizontal pivot axis therebetween.

15. The closure of claim 14, wherein the frangible border of the breakaway flap and the hinge provide an outer perimeter of the breakaway flap that is entirely, integrally coupled to the top wall to provide an unopened, hermetically-sealed configuration.

16. The closure of claim 14, wherein the frangible border has a smaller thickness compared to a thickness of the hinge so that the breakaway flap separates from the top wall only along the frangible border and remains attached to the top wall along the hinge.

17. The closure of claim 14, wherein the push pad includes a front wall, a pair of side walls, and a top wall, the front wall arranged adjacent to the frangible border, and the top wall of the push pad inclined to extend away from the hinge.

18. The closure of claim 17, wherein the frangible border is configured to at least partially separate from the top wall as the closure changes from the closed configuration to the product-dispensing configuration and the hinge allows the flap base and the push pad to pivot about the horizontal pivot axis after application of a downward force on the push pad by the user to break the frangible border.

19. The closure of claim 12, wherein the interruption is defined at least partially by a lip that is arranged to lie at an angle relative to a central axis of the closure.

20. The closure of claim 19, wherein the lip includes a first end spaced apart from an end of the hinge by a first circumferential distance that is greater than or equal to a thickness of the breakaway flap, and the lip includes a second end that is spaced apart from the end of the hinge by a second circumferential distance that is greater than the first circumferential distance.

* * * * *